United States Patent [19]

Kendall

[11] 3,997,361

[45] Dec. 14, 1976

[54] COIN CLEANER

[76] Inventor: Earl Wesley Kendall, Box 417, Bonita, Calif. 92002

[22] Filed: June 6, 1975

[21] Appl. No.: 584,397

[52] U.S. Cl. ..... 134/28; 134/3; 134/29; 134/30; 134/41; 252/142

[51] Int. Cl.[2] ..... B08B 30/00; C11D 7/08; C23G 1/02

[58] Field of Search ..... 252/79.2, 142; 134/3, 134/38, 39, 41, 28, 29, 30; 156/18

[56] References Cited

UNITED STATES PATENTS

| | | | |
|---|---|---|---|
| 2,428,464 | 10/1947 | Lum et al. | 252/79.2 |
| 2,705,191 | 3/1955 | Jumer | 134/3 X |
| 2,915,387 | 12/1959 | Kolodney | 252/142 X |
| 3,275,560 | 9/1966 | Wasserman | 252/79.2 |

OTHER PUBLICATIONS

Cleaning and Finishing of Aluminum and Aluminum Alloys, Metals Hand Book vol. 11, date 1961, pp. 617 and 618.

*Primary Examiner*—William A. Powell

[57] ABSTRACT

A two-constituent combination of phosphoric and nitric acids with a minimal volume of water. The composition is designed to remove stains, corrosion, dirt and encrustations from coinage metals composed mainly of copper, silver, brass, bronze and gold. No abrading action is required and there are no adverse effects on the substrate.

7 Claims, No Drawings

COIN CLEANER

This invention relates generally to the art of treating certain metals to produce desired surface effects such as removal of stains, corrosion products and encrustations and to enhance the appearance of the surface.

More specifically, the present invention is directed to a process and composition for the removal of stains, corrosion products and encrustations from copper, silver and gold coinage alloys by simple immersion in a chemical solution and with no abrading action required.

Various methods heretofore used or proposed for removing the objectionable overlay from copper, silver or gold coins have generally employed drastic chemical attack, mechanical or manual abrasion compounds incorporated in a paste matrix, or by electrolytic methods.

One recognized chemical composition for etching copper employs phosphoric, acetic and nitric acids in the volume ratio of 55/25/20 respectively. A formulation of this nature employing 20% nitric acid would so quickly degrade the surface of a coin, be it copper or silver, that the item would lose much of its intrinsic value. The rate of copper metal dissolution for instance employing the foregoing formulation is approximately 0.8 weight percent per minute. Silver would also be rapidly attacked since that metal is very soluble in nitric acid. Basic gold, however, would be unaffected.

Some formulations employ hot sulfuric acid while others use potassium cyanide neither of which is advocated nor used in the composition of this invention owing to the heat requirements of the acid and the toxicologic properties of the cyanide.

Another formulation for cleaning copper coins utilizes ordinary household vinegar (5% acetic acid) saturated with sodium chloride. This composition removes some of the discoloration from copper coins, but does little to enhance the surface appearance. It is completely ineffective on silver or gold coins. Furthermore, it will not remove corrosion from pitted areas.

Still another formulation for removing tarnish from silver and copper surfaces employs an acid medium in which an organic reducing agent such as thiourea is found. This, however, is totally ineffective on corrosion products frequently found on silver and copper coins.

Manual abrasion is laborious, tedious and time consuming and, because of the human element involved, the effects of texture, color and gloss are non-uniform from one surface to another. In addition, the abrasive action removes excessive metal, it scratches the surface, leaving a visible pattern of the abrading marks and strokes. Moreover, uniform removal of overlays cannot be accomplished by abrasive means when the object being treated manifests irregular surfaces such as grooves, deep indentations, etc. These areas would only serve to entrap and hold the abrading materials without visibly accomplishing the result intended. Furthermore, complete removal of the compound would require a brushing action of some nature.

Electrocleaning methods require a constant source of direct current. This is not readily available and requires expensive electrical equipment. In addition, it is a time consuming operation which, if not closely controlled and regulated, will remove some of the coin metal.

GENERAL SPECIFICATIONS OF THE INVENTION

The coin cleaner of this invention is an acidic solution which may be prepared from the constituent components. In general, the composition is comprised of inorganic materials such as phosphoric and nitric acids or a salt which hydrolyzes to nitric acid such as ammonium or sodium nitrate.

The absence of water, except that initially present in the acids, controls the rate of attack on the substrate metal by reducing the ionization of the acids. This feature considerably attenuates the otherwise drastic effects of the acids. However, activity is of such magnitude as to accomplish the removal of the overlay.

Furthermore, it has been found that a prior treatment of the coin in 6% to 10% ammonium hydroxide for approximately one-half minute considerably reduces the time for the removal of the overlay by the composition of this invention.

In the composition of this invention the phosphoric acid serves as the carrier and solvent for the nitrate salts which subsequently produce nitric acid in situ. Phosphoric acid per se has no solvent action on copper, silver or gold. The content of commercially available $H_3PO_4$ is approximately 85% orthophosphoric acid. The minimal water volume of the commercial product is adequate to dissolve the nitrate salt which subsequently hydrolyzes to nitric acid. The latter acid is the active material of the cleaner of this invention. It represents from one to five percent of the composition and may be prepared as shown in Table I.

The nitrate salt is used to introduce nitric acid into the solution without increasing the water volume. By so doing, the ionization of the system is maintained at a very low value and the pH stabilized at approximately 3.4 to 4.0. The nitric acid has sufficient activity at this concentration to remove the generally encountered salts of corrosion formed on the coinage metals. The concentration, however, should not exceed 5 weight percent, otherwise mild attack will ensue on the basis metal.

It should be noted that the weight of nitric acid in the commercial product designated as 70% with a specific gravity of 1.42 is approximately 1 gram, the balance, 0.42 gram, being water. The use of commercial nitric acid is permissible if the content does not exceed three weight percent. In order to produce the 5.1 grams required for the 3 weight percent as shown in Table 1, 7.29 milliliters of the commercial acid must be used. This volume also adds about 2.2 milliliters of water to the 24.7 milliliters already present in the 164.9 grams of phosphoric acid. Conversely, if ammonium nitrate is used to produce the equivalent weight of nitric acid, 1.5 milliliters of water are removed from the corresponding weight of $H_3PO_4$. As an example, in preparing a 3 weight percent solution of nitric acid in the phosphoric acid, 6.48 grams of ammonium nitrate would produce 5.1 grams of nitric acid. This weight based on the total weight of 170 grams of solution represents 3 weight percent of nitric acid. In this method of preparation the ammonium salt is dissolved in the water present in the phosphoric acid. This latter approach is preferred since the success of the cleaning solution is predicated on minimal volumes of water.

The cleaner of this invention may also be prepared from the anhydrides of phosphoric and nitric acids, i.e., $P_2O_5$ and $N_2O_5$ respectively as shown in the following equations:

$$P_2O_5 + 3H_2O \rightarrow 2H_3PO_4$$

and $$N_2O_5 + H_2O \rightarrow 2HNO_3$$

Table 1

Materials weight and volume of various concentrations of Coin Cleaner

| $NH_4NO_3$ grams | $HNO_3$ equiv. grams | $HNO_3$ solution wgt. % | $H_3PO_4$ volume ml. | $H_3PO_4$ weight grams |
|---|---|---|---|---|
| 0.00 | 0.00 | 0.00 | 100.0 | 170 |
| 1.08 | 0.85 | 0.50 | 99.5 | 169.2 |
| 2.16 | 1.70 | 1.00 | 99.0 | 168.3 |
| 4.32 | 3.40 | 2.00 | 98.0 | 166.6 |
| 6.48 | 5.10 | 3.00 | 97.0 | 164.9 |
| 8.64 | 6.80 | 4.00 | 96.0 | 163.2 |
| 10.8 | 8.50 | 5.00 | 95.0 | 161.5 |

In this method of preparation 101.5 grams of $P_2O_5$ dissolved in 38.66 milliliters of water will produce 140.2 grams of phosphoric acid. However, to establish weights equivalent to those shown for a 3 weight percent nitric acid solution in Table 1, 24.7 milliliters of water must be added to the phosphoric acid. The nitric acid would be prepared by dissolving 4.37 grams of $N_2O_5$ in 0.73 gram of water to produce the 5.1 grams of acid required.

The nitrate salts of ammonium, sodium and potassium are highly desirable with the ammonium salt preferred owing to the cost factor and weight required to produce equivalent amounts of nitric acid. The preferred concentration of nitric acid produced in situ in the cleaner of this invention is one weight percent. There is sufficient activity at this density to remove corrosion or encrustations in a minimal period of time and with a resulting high luster to the surface of the coin.

As the solids content of the cleaner builds up and the activity of the nitric acid decreases, a point of exhaustion is eventually reached. It is possible at this point to rejuvenate the solution and restore activity to the cleaner by adding and dissolving a weighed amount of nitrate salt. However, a plateau is eventually obtained where fresh material will not enter into solution. This represents complete exhaustion and the solution must be discarded.

It has been observed that a prior treatment of the coin in a 6% to 10% ammonium hydroxide solution (non-detergent household ammonia) for approximately one-half minute expedites the removal of the overlay by the composition of this invention.

The general object of the present invention is to provide a new and novel method for the safe removal of stains, corrosion products and encrustations from coinage metals and their alloys by simple immersion in a chemical solution for a brief period of time.

A further object is to provide a controlled acidic-type coin cleaner of the aforedescribed character which can be varied as to its constituents and proportions thereto and which optionally may be in the form of immersion or wiping consistency or in the form of a viscous material for a "brush-on" application.

Yet another object is to provide an acidic-oxidizer type overlay remover from coinage alloys which is operative at ambient temperature and effective in a matter of a few minutes with no attack or adverse effects on the underlying substrate.

FORMULATION

One specific formulation which is particularly adapted to and suitable for the removal of stains, corrosion and encrustations from coinage metals includes the following materials in the quantities indicated:

| | | |
|---|---|---|
| Orthophosphoric acid (85%) | grams | 168.30 |
| Ammonium nitrate | grams | 2.16 |

The concentration and constituents may be varied from the optimum as represented in the foregoing formulation and are shown in the following examples:

| | | |
|---|---|---|
| Orthophosphoric acid (85%) | grams | 161.5 – 169.2 |
| Ammonium nitrate | grams | 1.08 – 10.8 |
| Orthophosphoric acid (85%) | grams | 164.9 – 169.2 |
| Nitric acid (70%) | grams | 0.85 – 5.10 |

PREPARATION AND USE OF THE COIN-CLEANER

Completely dissolve 2.16 grams of ammonium nitrate in 168.3 grams of orthophosphoric acid (85%) in a plastic or glass container only. This will require a period of from 15 to 45 minutes. The following reaction ensues in which the nitrate salt reacts with the water present in the orthophosphoric acid:

$$NH_4NO_3 + H_2O \rightarrow HNO_3 + NH_4OH$$

The ammonium hydroxide is immediately neutralized by the phosphoric acid with the production of ammonium phosphate. It is shown in this reaction that 1 mole of ammonium nitrate produces 1 mole of nitric acid. Based on molecular weight relationships 1 gram of the nitrate will yield 0.79 gram nitric acid or conversely 1 gram of nitric acid results from the reaction of water and 1.27 grams of ammonium nitrate. It is to be construed that in all calculations involved, the concentration of orthophosphoric acid is 85% with a specific gravity based on 1.7.

Preclean the coin by immersing in non-detergent-type household ammonia for a period not to exceed one-half minute. Rinse thoroughly with tap water and dry the coin and all equipment prior to entering the cleaner.

Place the coin in the cleaner of this invention in such a manner that all areas of the metal are in contact with the liquid. Allow to remain ½ to 5 minutes or until evidence of stains, corrosion or encrustations has disappeared. Remove the coin with plastic tweezers, flush thoroughly with cold water, then dry.

The novel principles of this invention transcend the scope of the invention as suggested or implied by the several embodiments hereinbefore described, and the invention may be embodied in other forms or carried out in other ways which have been conceived and reduced to practice during the course of this development, without departing from the spirit or essential characteristics of the invention. The embodiments disclosed herein, therefore, are to be considered as in all respects illustrative and not restrictive, the scope of the invention being indicated by the appended claims and all changes which come within the meaning and range of equivalency of the claims are intended to be embraced therein.

Having thus described my invention, what I claim as new and useful and desire to secure by letters patent is:

1. A nitric-phosphoric acid composition operable at ambient temperature of the order of 15° C to 38° C and effective within about ½ to 5 minutes. For removing overlay stains, corrosion and encrustations from the surfaces of copper, silver or gold coins immersed therein without ensuing attack on the substrate metal, said composition comprising 161.5 to 169.2 grams of orthophosphoric acid(85%) and 1.08 to 10.8 grams of ammonium nitrate dissolved in the water present in the orthophosphoric acid and hydrolyzed to form 0.85 to 8.5 grams of nitric acid in situ.

2. A composition as defined in claim 1 in which 0.85 to 5.10 grams of nitric acid (70%) is substituted for the ammonium nitrate.

3. A composition as defined in claim 2 in which one or both acids and their concentrations in solution are formed from their respective anhydrides $P_2O_5$ and $N_2O_5$ and water.

4. A composition as defined in claim 1 wherein the optimum formulation comprises 168.30 grams orthophosphoric acid (85%) and 2.16 grams ammonium nitrate.

5. A process for the removal of stains, corrosion and encrustations from coins without attack on the substrate metal comprising applying to the surface of the coins a nitric-phosphoric acid composition formed by dissolving about 1.08 to 10.8 grams of ammonium nitrate in about 161.5 to 169.2 grams of orthophosphoric acid (85%), and maintaining the coins in contact with said composition operated at ambient temperature of the order of 15° C to 38° C for a period of time of the order of ½ to 5 minutes.

6. A process as defined in claim 5 in which the cleaning solution is comprised of 164.9 to 169.2 grams of orthophosphoric acid(85%) and 0.85 to 5.10 grams of nitric acid (70%).

7. A process as defined in claim 5 in which the nitric-phosphoric acid cleaning composition is applied after first precleaning the coins in a non-detergent 6 to 10 percent ammonium hydroxide solution for a period not to exceed one minute.

* * * * *